US005387148A

United States Patent [19]

Dideriksen et al.

[11] Patent Number: 5,387,148

[45] Date of Patent: Feb. 7, 1995

[54] GRAB FOR A TOY CRANE

[75] Inventors: Erling T. Dideriksen, Billund; Kim Pagel, Vandel, both of Denmark

[73] Assignee: Interlego A.G., Baar, Switzerland

[21] Appl. No.: 70,436

[22] PCT Filed: Dec. 3, 1991

[86] PCT No.: PCT/DK91/00370

§ 371 Date: Jun. 29, 1993

§ 102(e) Date: Jun. 29, 1993

[87] PCT Pub. No.: WO92/10257

PCT Pub. Date: Jun. 25, 1992

[30] Foreign Application Priority Data

Dec. 4, 1990 [DK] Denmark ..... 2872/90

[51] Int. Cl.[6] ..... A63H 33/30; A63H 17/12; B66C 1/00

[52] U.S. Cl. ..... 446/424; 446/425; 294/112

[58] Field of Search ..... 446/424, 425, 426, 427, 446/428; 294/112, 111; 37/184, 185

[56] References Cited

U.S. PATENT DOCUMENTS

| | | | |
|---|---|---|---|
| 149,143 | 3/1874 | Morris | 294/112 X |
| 987,418 | 3/1911 | Wetherill | 294/112 |
| 1,488,210 | 3/1924 | Lewis | 294/112 |
| 2,166,854 | 7/1939 | Bartlett . | |
| 2,399,547 | 4/1946 | Hay | 294/112 |
| 2,590,188 | 3/1952 | Landree | 446/426 X |
| 3,115,361 | 12/1963 | Miles | 294/112 |
| 3,245,712 | 4/1966 | Mitchell | 294/112 |
| 3,788,694 | 1/1974 | Hall | 294/112 X |
| 4,261,133 | 4/1981 | Hanson et al. | 446/424 X |

FOREIGN PATENT DOCUMENTS

| | | | |
|---|---|---|---|
| 833169 | 3/1952 | Germany . | |
| 14254 | 2/1926 | Netherlands | 294/111 |
| 619367 | 6/1947 | United Kingdom . | |
| 1740301 | 6/1992 | U.S.S.R. | 294/112 |

*Primary Examiner*—Robert A. Hafer
*Assistant Examiner*—D. Neal Muir
*Attorney, Agent, or Firm*—Kane, Dalsimer, Sullivan, Kurucz, Levy, Eisele and Richard

[57] ABSTRACT

A grab for a toy crane is provided with two two-armed levers having a common axis of rotation. Portions of the levers overlap each other at the axis of rotation about which the levers are mutually hinged at at least two places. Each lever has a first arm and a second arm which are mutually contiguous solely on one side of a central plane of the grab perpendicular to the axis of rotation.

10 Claims, 1 Drawing Sheet

GRAB FOR A TOY CRANE

BACKGROUND OF THE INVENTION

The invention concerns a grab for a toy crane, said grab having two two-armed levers adapted to grip an object by mutual movement above their axis of rotation, said levers being hinged at at least two places along their axis of rotation.

The DE Patent 833 169 discloses such a grab which is suspended from a crane arm in two separate cords. The grab can be raised and lowered with operating means on the crane with simultaneous rolling up or rolling out of both cords, and the grab can be closed or opened by shortening or extending one of the cords with respect to the other. This known grab requires a separate cord for its opening/closing function and cannot therefore be retained in a closed state without this separate cord.

Also U.S. Pat. No. 2,166,854 shows such a crane grab, but whose jaws have suspension points outside their common pivot shaft, and the jaws are connected in these points with a common, carrying cord. Another cord is connected with the pivot shaft, and the jaws of the grab can be opened and closed by different pull in these cords. However, the jaws of the grab have no mutually intersecting parts like in the present invention.

GB 619 367 shows a toy crane with a grab whose parts intersect each other in a common fulcrum, and these parts are just hinged in this single fulcrum.

SUMMARY OF THE INVENTION

The present invention provides a grab which is inexpensive to produce, is functional and is realistic in use.

It is first and foremost possible to manufacture the two two-armed levers of the grab as identical parts, which is an advantage in terms of production. Further, it is hereby possible to let the two levers intersect each other seen in projection along the axis of rotation, so that their mutual movement about the axis of rotation will be a scissors-like movement. This movement makes it possible to use the gravitational pull from the object which the grab carries to intensify the grip of the grab of the object, which can hereby be retained safely by the grab at any time.

When the hinges are constructed as integrated parts of the levers, an additional productional advantage is obtained since no separate shaft or other hinge device is needed.

The grab of the invention lends itself for use with a crane where a U-shaped loop on an endless cord carries the grab.

The gripping face of the grab, which is advantageously so constructed as to provide relatively great friction between the gripping face of a grab and the objects which is gripped.

BRIEF DESCRIPTION OF THE DRAWINGS

A preferred embodiment of the invention will be described below with reference to the drawing, in which.

DETAILED DESCRIPTION OF THE PREFERRED EMBODIMENT

Figure 1:
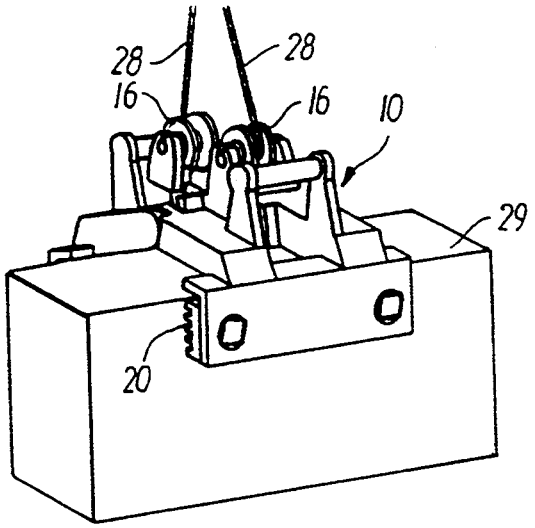
FIG. 1 is a perspective view of a grab of the invention carrying an object, FIG. *2a* shows the two halves of the grab of FIG. 1, seen from the side, FIG. *2b* shows the assembled grab, seen from the side, FIG. *3a* shows the two halves of the grab, seen from above, and FIG. *3b* shows the assembled grab, seen from above.
Figure 2A:
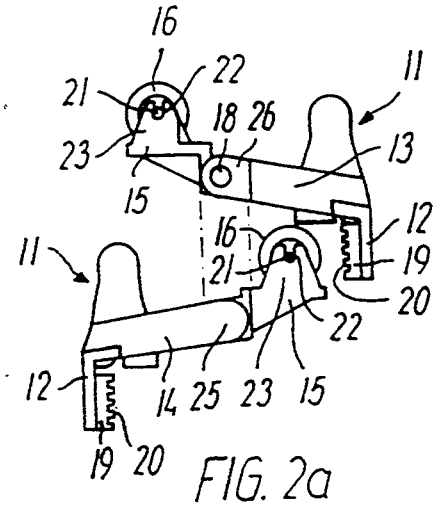
Figure 3A:
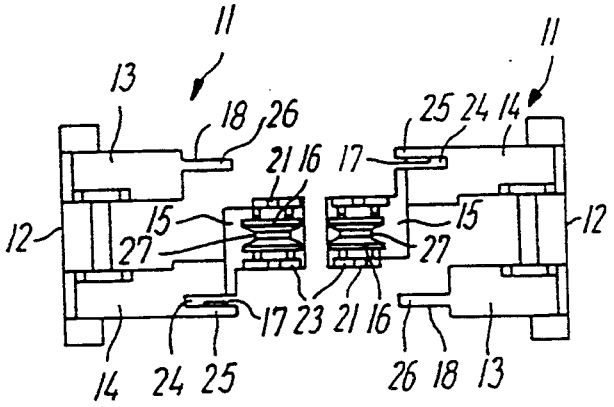
Figure 2B:
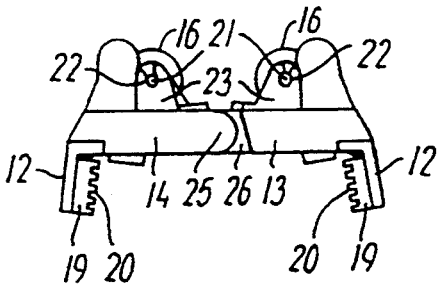
Figure 3B:
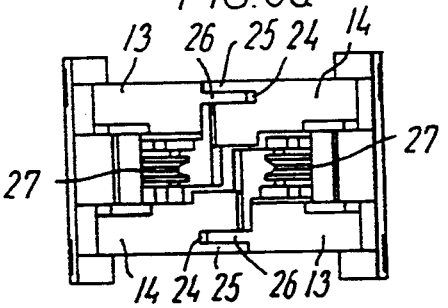

A grab 10 consists of two identical halves 11 preferably made of plastics. Each half 11 has a gripping member 12 formed as a rectangular plate. Two substantially box-shaped parts 13 and 14 are provided from the upper edge of the gripping member 12, said parts extending mutually in parallel at a certain distance from each other and forming an angle with the gripping member 12 which is approximately a right or a slightly obtuse angle. The inner side of the gripping members 12 is formed with a part 19 which has ribs 20 on the part of its face which is directed away from the gripping member 12. The part 19 is preferably made of rubber or another material having a relatively great coefficient of friction.

From the free end of the box-shaped part 14, a bracket 15 extends further forwardly and offset toward the other box-shaped part 13. The bracket 15 carries two uprights 23 which have depressions 22 at the top serving as bearings for the shaft 21 of a pulley 16.

An incision 24 is provided at the free end of the box-shaped part 14, said incision being defined by a flap 25 at one side. The flap 25 carries a circular projection 17 on the side of it which faces inwardly toward the incision 24. The other box-shaped part 13 is formed with a projecting flap 26 having on its outwardly facing face a circular depression 18 with dimensions enabling the projection 17 to fit in it. The flap 26 has a thickness so as to fit in the incision 24.

As mentioned, the assembled grab 10 consists of two uniform halves 11. FIG. *2a* shows how the two halves 11 are placed one above the other before being assembled. During assembly, the central brackets 15 of the respective halves 11 are moved up and down, respectively, into the gap between the box-shaped parts 13 and 14 of the opposite part 11, and the flaps 26 are passed into the incisions 24. When the flap 26 touches the projection 17 on the flap 25, it will flex outwardly owing to the flexible properties of the material and open the incision 24 so that the flap 26 can be completely engaged with the incision 24. When the depression 18 on the flap 26 is opposite the projection 17 on the flap 25, the flap 25 moves resiliently backwards, and the projection 17 retains the two parts 11 with respect to each other by snap cooperation with the depression 18.

Thus, the flaps 25 with the projections 17 and the flaps 26 with the depressions 18 define a hinge with an axis of rotation through the two pairs of projections 17 and depressions 18 in engagement with each other, so that the two parts 11 of the grab can perform a mutual movement about the axis of rotation thus defined.

The pulleys 16 has a peripheral depression or groove 27 disposed in the central plane of the assembled grab perpendicular to the axis of rotation through the hinge elements 17, 18, 18, 17.

FIG. 1 shows how the grab 10 is suspended in a cord 28 forming a U-shaped loop and being engaged with both pulleys 16. The grab 10 grips an object 29, with the ribs 24 on the gripping faces engaging the object 29, which is retained owing to the friction between the ribs and the upper face of the object 29.

The cord 28 exerts a pull in both pulleys 16, and the central bracket 15 with the pulley 16 constitutes one arm of a two-armed lever for each of the parts 11, while the box-shaped part 14 constitutes the other arm. The cord 28, when pulling the pulleys 16, will thus cause the assembled grab 10 to grip the object 29.

In the shown embodiment, the rubber parts 19 with ribs 20 are adapted to grip the object 29 and retain it by means of friction between the ribs 20 and the surface of the object 29, the part 19 may also be provided with means in the form of projections and/or recesses adapted to engage corresponding complementary parts on the object 29, which is then retained by purely mechanical means and not by friction.

We claim:

1. A grab for a toy crane, comprising two, two-armed levers, said levers having a common axis of rotation and arranged to overlap so as to engage in a releasable, rotatable snap-fit connection with each other at the axis of rotation, said arms being mutually hinged at at least two points along the axis of rotation, wherein each lever comprises a first arm and a second arm each said lever comprising engagement means to engage suspension means from a toy crane, said arms of each lever being contiguous essentially on one side of a central plane of the grab which is perpendicular to said axis whereby the grab is adapted to grip an object by mutual movement of the levers about the axis of rotation.

2. A grab according to claim 1, characterized in that the hinges are constructed as integral parts (25, 17; 26, 18) of respective ones of the levers.

3. A grab according to claim 2, characterized in that each lever has hinge parts (26, 24; 17, 18) mutually complementary in pairs for cooperation with the corresponding hinge parts of the other lever.

4. A grab according to claim 1, characterized in that the engagement means is adapted to hang in a U-shaped loop on an endless cord (28).

5. A grab according to claim 4, characterized in that both levers are adapted to cooperate with the cord (28).

6. A grab according to claim 4, characterized in that the engagement means cooperates freely movably with the cord (28).

7. A grab according to claim 6, characterized in that each of the levers has a pulley (16) for cooperation with a cord (28) from a toy crane.

8. A grab according to claim 1, characterized in that each lever features a gripping face (12) with a friction increasing part (19).

9. A grab according to claim 8, characterized in that the gripping faces has a friction increasing shape (20).

10. A grab according to claim 1, characterized in that its two-armed levers (11) are constructed as substantially identical parts.

* * * * *